US006498906B2

(12) United States Patent
Kimoto et al.

(10) Patent No.: US 6,498,906 B2
(45) Date of Patent: Dec. 24, 2002

(54) IMAGE FORMING APPARATUS HAVING FIXING DEVICE FOR FIXING DEVELOPER IMAGE ON RECORDING MEDIUM BY INDUCTION-HEATING HEAT ROLLER

(75) Inventors: Taizo Kimoto, Tokyo (JP); Hisaaki Kawano, Chigasaki (JP); Hiroshi Nakayama, Kawasaki (JP); Kenji Takano, Tokyo (JP); Noriyuki Umezawa, Yokohama (JP); Osamu Takagi, Tokyo (JP); Satoshi Kinouchi, Tokyo (JP); Kazuhiko Kikuchi, Yokohama (JP); Masahiko Ogura, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/057,995

(22) Filed: Jan. 29, 2002

(65) Prior Publication Data

US 2002/0067926 A1 Jun. 6, 2002

Related U.S. Application Data

(63) Continuation of application No. 09/939,571, filed on Aug. 28, 2001, now abandoned, which is a continuation of application No. PCT/JP99/07408, filed on Dec. 28, 1999.

(51) Int. Cl.[7] ..... G03G 15/20

(52) U.S. Cl. ..... 399/33; 219/619

(58) Field of Search ..... 399/67, 69, 33, 399/24; 219/216, 619, 660

(56) References Cited

U.S. PATENT DOCUMENTS

| | | | | |
|---|---|---|---|---|
| 5,386,272 | A | 1/1995 | Nakazato | 399/33 |
| 5,794,096 | A | 8/1998 | Okabayashi | 399/33 |
| 5,802,421 | A | 9/1998 | Miura | 399/33 |
| 5,854,959 | A | 12/1998 | Mirabella, Jr. | 399/69 |
| 5,911,094 | A | 6/1999 | Tsujimoto | 399/69 |
| 6,097,904 | A | 8/2000 | Tsuruno et al. | 399/33 |
| 6,137,969 | A | 10/2000 | Tsujimoto | 399/69 |
| 6,173,131 | B1 | 1/2001 | Kitamura et al. | 399/33 |

FOREIGN PATENT DOCUMENTS

| | | |
|---|---|---|
| JP | 4-283782 | 10/1992 |

*Primary Examiner*—Susan S. Y. Lee
(74) *Attorney, Agent, or Firm*—Foley & Lardner

(57) ABSTRACT

When a voltage abnormality error signal from a drive control section is at a low level, a control section determines a normal state. When the voltage abnormality error signal has arisen to a high level, the control section does not immediately determine an abnormal state and instead measures a time in which the voltage abnormality error signal is at the high level. If the measured time does not exceed a predetermined error timer value (limit value) T, the control section ignores this abnormal state as a temporary voltage abnormality. If the time in which the voltage abnormality error signal is at the high level exceeds the error timer value T, the control section determines a serviceman call error (SC) as the occurrence of voltage abnormality.

10 Claims, 6 Drawing Sheets

IMAGE FORMING APPARATUS HAVING FIXING DEVICE FOR FIXING DEVELOPER IMAGE ON RECORDING MEDIUM BY INDUCTION-HEATING HEAT ROLLER

CROSS REFERENCE TO RELATED APPLICATIONS

This is a Continuation application of U.S. Ser. No. 09/939,571, filed Aug. 28, 2001, now abandoned which is a Continuation Application of PCT Application No. PCT/JP99/07408, filed Dec. 28, 1999, which was not published under PCT Article 21(2) in English.

BACKGROUND OF THE INVENTION

1. Field of the Invention

The present invention relates to an image forming. apparatus having a fixing device for fixing a developer image on a recording medium by means of self-heating of a heating member based on loss of an eddy current caused in the heating member by applying a radio-frequency magnetic field generated by a coil to the heating member.

2. Description of the Related Art

In an image forming apparatus using digital technology, generally known as an electronic copying machine, an original table on which an original is placed is exposed. An image signal corresponding to a reflection light amount from the original table is obtained from a CCD (charge-coupled device) line sensor. A laser beam corresponding to the image signal obtained from the line sensor is radiated on a photosensitive drum, and thus an electrostatic latent image is formed on a peripheral surface of the photosensitive drum. The electrostatic latent image is changed to a visible image by adherence of a developer (toner) which is (negatively) charged in advance. A paper sheet is fed to the photosensitive drum in accordance with the timing of rotation of the photosensitive drum, and the visible image (developer image) on the photosensitive drum is transferred onto the paper sheet. The paper sheet with the transferred developer image is fed to a fixing device.

The fixing device comprises a heating roller and a pressing roller put in pressure contact with the heating roller. The paper sheet is inserted between both rollers, and while the sheet is being conveyed, the developer image on the sheet is fixed by the heat of the heating roller.

An example of a heat source for the heating roller is an induction heater. The induction heater comprises a coil contained within the heating roller, and a radio-frequency generating circuit for supplying a radio-frequency current to the coil.

The radio-frequency generating circuit comprises a rectifier circuit for rectifying an AC power supply voltage, and a switching circuit for converting an output voltage (DC voltage) of the rectifier circuit to a radio-frequency power with a predetermined frequency. The coil is connected to an output terminal of the radio-frequency generating circuit (an output terminal of the switching circuit).

When the radio-frequency generating circuit is operated, a radio-frequency current is supplied to the coil, and the coil generates a radio-frequency magnetic field. The radio-frequency magnetic field is applied to the heating roller, and an eddy current is produced in the heating roller. The heating roller emits heat by itself based on a loss of the eddy current, and the developer image on the paper sheet is fixed by the heat.

In the case of the fixing device using the above-described induction heater, there are such error statuses as IGBT abnormality, voltage abnormality, circuit failure, and coil breakage.

In the case of the fixing device using the induction heater, however, the range of a voltage margin of an induction heater unit side circuit is narrower than that of a voltage margin of the image forming apparatus body. Thus, compared to a case where a conventional heater is used, the frequency of error statuses relating to voltage variations increases and the control may be disabled.

BRIEF SUMMARY OF THE INVENTION

The present invention has been made in consideration of the above circumstances, and the object of the invention is to avoid a control-disabled state by properly coping with an error status in accordance with a voltage variation.

The present invention provides an image forming apparatus for forming an image, including a fixing device having a coil in a heating roller and causing the coil to generate a radio-frequency magnetic field, thereby producing an eddy current in the heating roller and fixing a developer image on a recording medium by means of self-heating of the heating roller based on an eddy current loss, the apparatus comprising: receiving means for receiving a voltage abnormality error signal from the fixing device; time-measuring means for measuring a reception time of the voltage abnormality error signal when the receiving means has received the voltage abnormality error signal; confirmation means for confirming whether the reception time measured by the time-measuring means exceeds a predetermined limit value; first control means for executing a control to ignore the voltage abnormality when the conformation means has confirmed that the limit value is not exceeded; and second control means for executing a control to perform an error process for the occurrence of voltage abnormality, when the confirmation means has confirmed that the limit value is exceeded.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will now be described.

Figure 1:
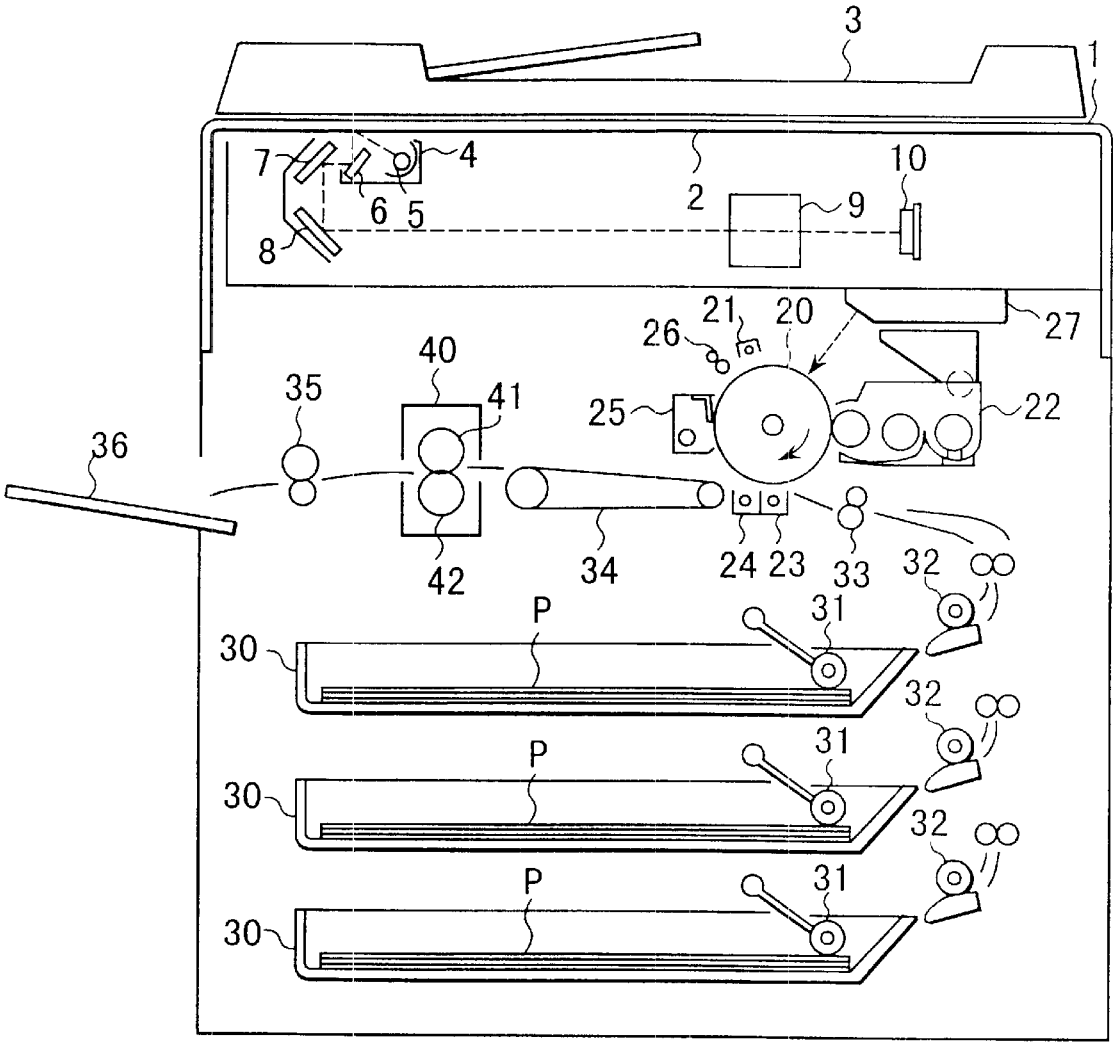
FIG. 1 shows a whole structure of an electronic copying machine.

FIG. 1 shows an internal structure of an image forming apparatus, e.g. an electronic copying machine.

An original table 2 for placement of an original is provided at an upper part of a main body 1. An automatic original feeder 3 is provided on the original table 2. The automatic original feeder 3 automatically feeds originals one by one onto the upper surface of the original table 2.

A carriage 4 is reciprocally movably provided on the lower side of the original table 2. An exposure lamp 5 is provided on the carriage 4. The carriage 4 is reciprocally moved while the exposure lamp 5 is being turned on. Thus, the entire surface of the original table 2 is exposed and scanned.

By the exposure scan, a reflection light image of the original placed on the original table 2 is obtained. The reflection light image is projected on a CCD (charge-coupled device) line sensor (CCD sensor) 10 via reflection mirrors 6, 7 and 8 and a magnification-variable lens block 9. The CCD sensor 10 outputs an image signal of a voltage level corresponding to a reception light amount. The image signal is supplied to a laser unit 27. The laser unit 27 emits a laser beam corresponding to the image signal.

A photosensitive drum 20 is rotatably provided within the main body 1. The photosensitive drum 20 is successively surrounded by an electrifying charger 21, a developing unit 22, a transfer charger 23, a separating charger 24, a cleaner 25 and a destaticizer 26. The laser beam emitted from the laser unit 27 is passed between the electrifying charger 21 and developing unit 22 and strikes the peripheral surface of the photosensitive drum 20.

A plurality of sheet feed cassettes 30 are disposed at a bottom portion within the main body 1. A great number of copying sheets P serving as recording media are contained in the individual sheet feed cassettes 30.

Each sheet feed cassette 30 is provided with a pick-up roller 31 for picking up copying sheets P one by one.

At the time of copying, copying sheets P are picked up one by one from any one of the sheet feed cassettes 30. The picked-up copying sheet P is separated from the sheet feed cassette 30 by a separator 32, and fed to a register roller 33. The copying sheet P stands by there for rotation of the photosensitive drum 20. In accordance with the timing of rotation of the photosensitive drum 20, the register roller 33 feeds the copying sheet P between the transfer charger 23 and photosensitive drum 20.

When the copying operation is performed, the photosensitive drum 20 rotates clockwise, as shown in the figure. The electrifying charger 21 applies a high voltage supplied from a high voltage supply section (not shown) to the photosensitive drum 20, and electrifies the surface of the photosensitive drum 20 with electrostatic charge. An electrostatic latent image is formed on the photosensitive drum 20 by the electrification and the radiation of the laser beam from the laser unit 27 on the photosensitive drum 20.

The developing unit 22 supplies a developer to the photosensitive drum 20. With the supply of the developer, the electrostatic latent image on the photosensitive drum 20 is changed to a visible image. The transfer charger 23 transfers the visible image (developer image) from the photosensitive drum 20 onto the copying sheet P fed from the register roller 33. The copying sheet P with the transferred image is separated from the photosensitive drum 20 by the separating charger 24. The separated copying sheet P is brought to a fixing device 40 by a convey belt 34.

The fixing device 40 comprises a heating roller 41 and a pressing roller 42. The copying sheet P is inserted between both rollers, and while the paper sheet P is being conveyed, the developer image on the copying sheet P is fixed by the heat of the heating roller 41. The copying sheet P coming out of the fixing device 40 is output to a tray 36 by conveyance rollers 35.

Figure 2:
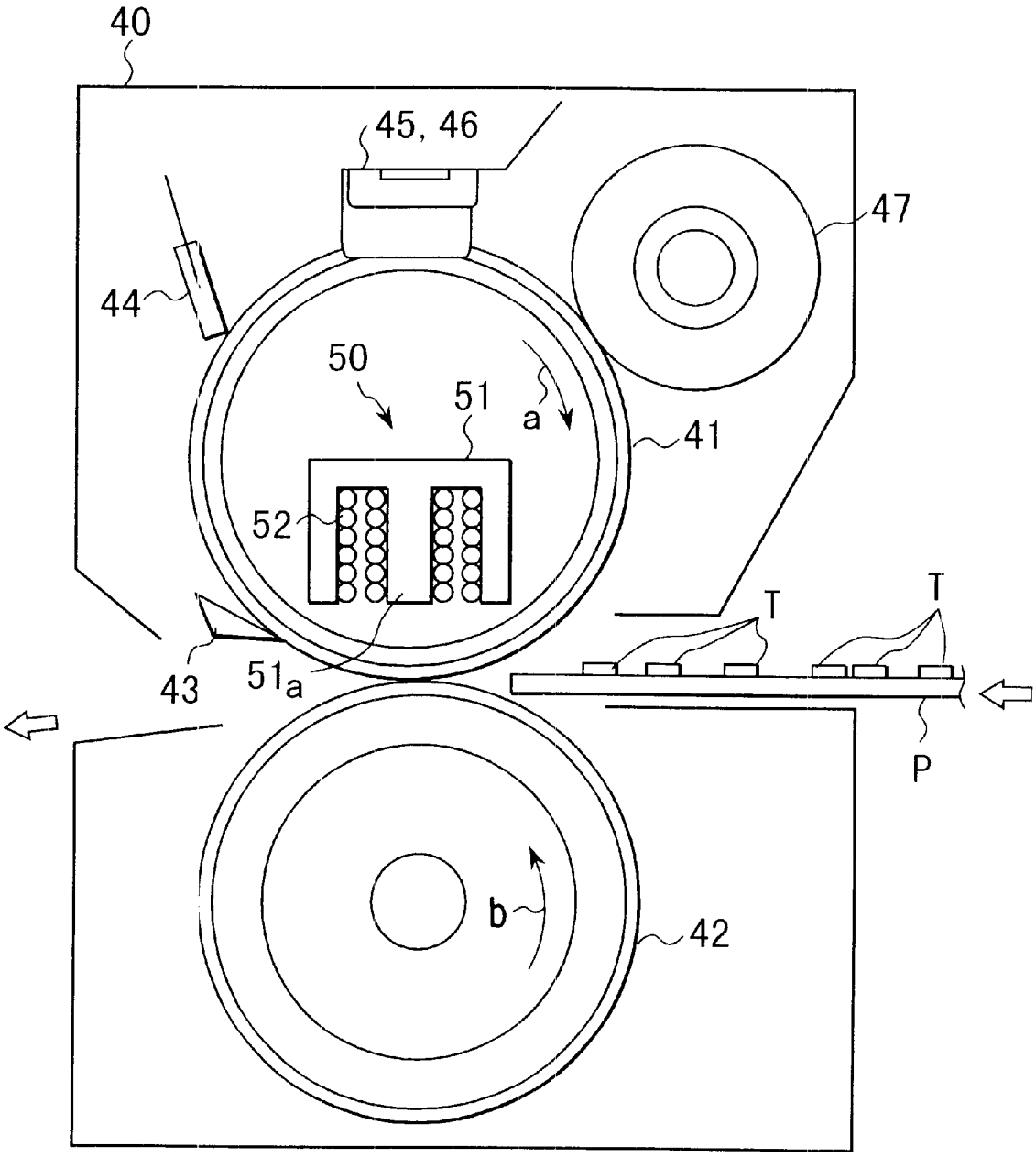
FIG. 2 shows the structure of a fixing device.

FIG. 2 shows a specific structure of the fixing device 40.

The electrically conductive heating roller 41 and the pressing roller 42 put in rotational contact with the heating roller 41 under pressure are disposed at such positions as to vertically sandwich the convey path of the copying sheet P. A rotational contact portion between both rollers 41 and 42 is maintained to have a predetermined nip width.

The heating roller 41 is rotated in the direction of an arrow. The pressing roller 42 rotates in the direction of an arrow, following the rotation of the heating roller 41. The copying sheet P passes through the rotational contact portion (fixation point) between the heating roller 41 and pressing roller 42, and the copying sheet P receives heat from the heating roller 41. Thereby, a developer image T on the copying sheet P is fixed on the copying sheet P.

The heating roller 41 is surrounded by a separation gripper 43 for separating the copying sheet P from the heating roller 41; a cleaning member 44 for removing toner and dust, e.g. paper dust, left on the heating roller 41; thermistors 45 and 46 for sensing a surface temperature Tr of the heating roller 41, the thermistor 45 being provided at a central portion of the heating roller 41, and the thermistor 46 being provided at an end portion of the heating roller 41; and a releasing agent applying device 47 for applying a releasing agent to the surface of the heating roller 41.

An induction heater 50 functioning as a heat source is contained within the heating roller 41. The induction heater 50 comprises a core 51 and a coil 52 wound around the core 51. A radio-frequency magnetic field is generated from the coil 52 to induction-heat the heating roller 41.

Specifically, a radio-frequency current is supplied to the coil 52 from a radio-frequency generating circuit 61 (to be described later), and the coil 52 generates a radio-frequency magnetic field. The radio-frequency magnetic field causes an eddy current in the heating roller 41. The heating roller 41 produces heat by itself on the basis of an eddy current loss due to the eddy current and the resistance of the heating roller 41.

Figure 3:
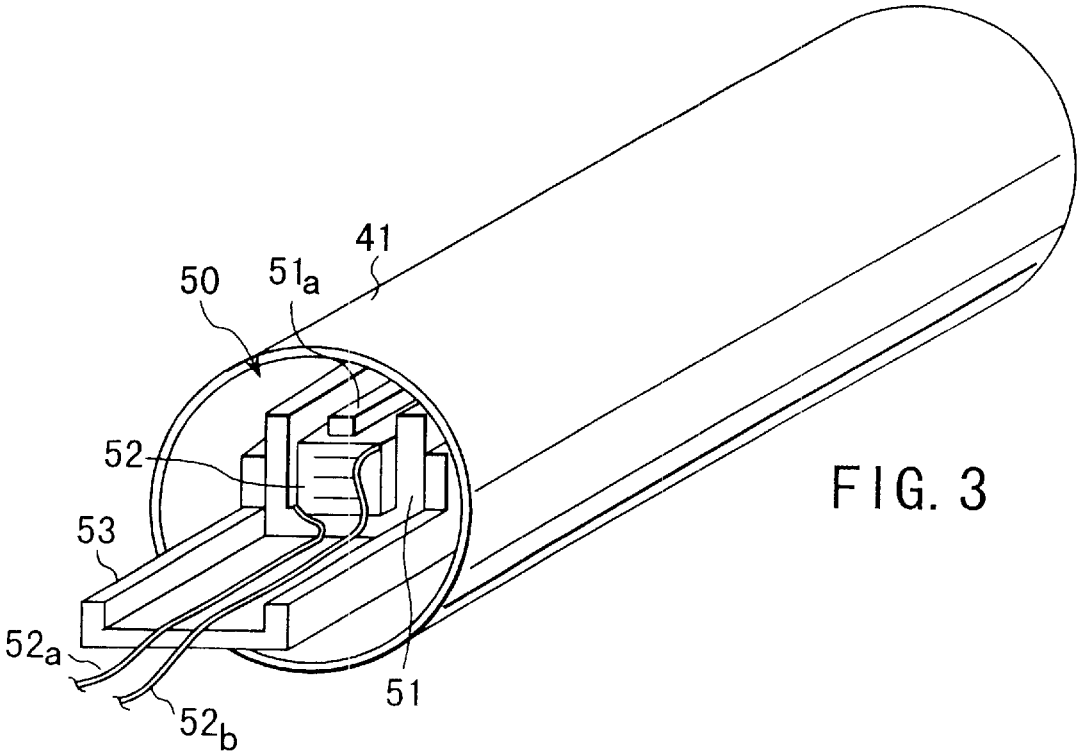
FIG. 3 shows the structure of a main part of an induction heater.

As is shown in FIG. 3, support members 53 are attached to both end portions of the core 51, and each support member 53 is fixed to a fixing metal plate (not shown) of the main body 1. The induction heater 50 is supported by the support members 53, separately from the heating roller 41.

Figure 4:
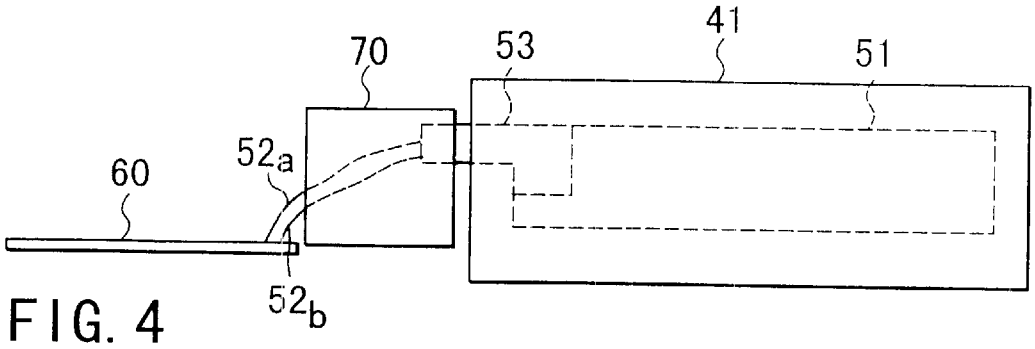
FIG. 4 shows connection between the induction heater and a circuit board.

As is shown in FIG. 4, electric wires (so-called lead lines) 52*a* and 52*b* are connected to both ends of the coil 52, and the electric wires 52*a* and 52*b* are connected to an induction heater side circuit board 60. A shield member 70 for magnetically shielding the electric wires 52*a* and 52*b* are provided to surround the electric wires 52*a* and 52*b*.

Figure 5:
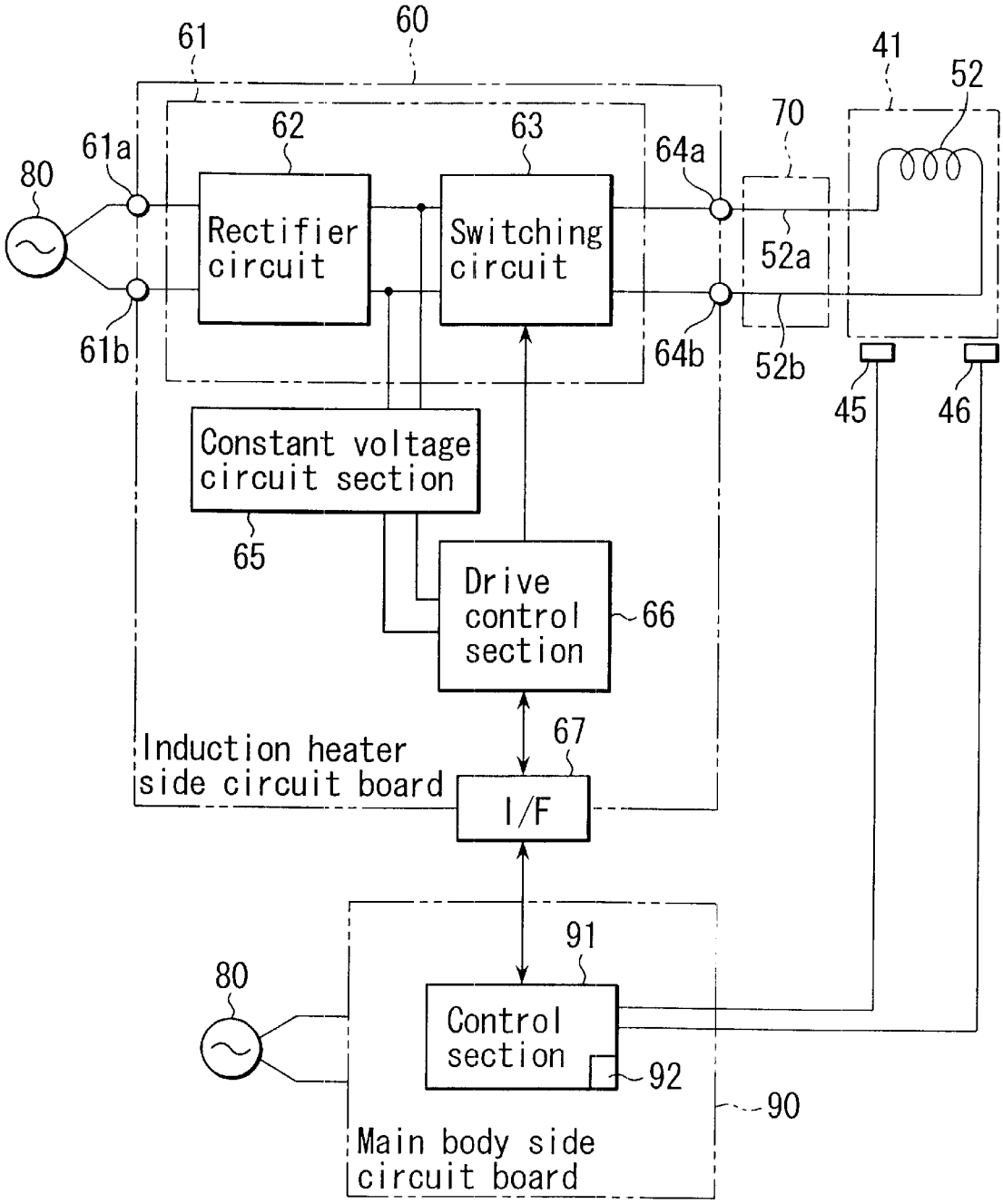
FIG. 5 is a block diagram of the induction heater and an electric circuit of the body.

The circuit board 60, as shown in FIG. 5, comprises input terminals 61*a*, 61*b* connected to a commercial AC power supply 80; the radio-frequency generating circuit 61 connected to the input terminals 61*a*, 61*b*; output terminals 64*a*, 64*b* connected to output terminals of the radio-frequency generating circuit 61; a constant voltage circuit section 65 connected to the input terminals 61*a*, 61*b*; a drive control section 66 connected to output terminals of the constant voltage circuit section 65; and an interface 67 for data transmission/reception between the drive control section 66 and a main body side circuit board 90.

A rectifier circuit 62 rectifies a voltage of the commercial AC power supply 80. A switching circuit 63 converts an output voltage (DC voltage) of the rectifier circuit 62 to a radio-frequency power of a predetermined frequency. The constant voltage circuit section 65 controls the output voltage of the rectifier circuit 62 at a fixed level proper to the operation of the drive control section 66 and outputs the controlled voltage. The drive control section 66 controllably drives the switching circuit 63 in accordance with an instruction from a control section 91 of the main body side circuit board 90.

The aforementioned electric wires 52*a* and 52*b* are connected to the output terminals 64*a* and 64*b* of the circuit board 60.

The main body side circuit board 90 is connected to the commercial AC power supply 80. Various electric circuit components of the main body 1 (not shown), as well as the control section 91, are mounted on the main body side circuit board 90.

Figure 6:
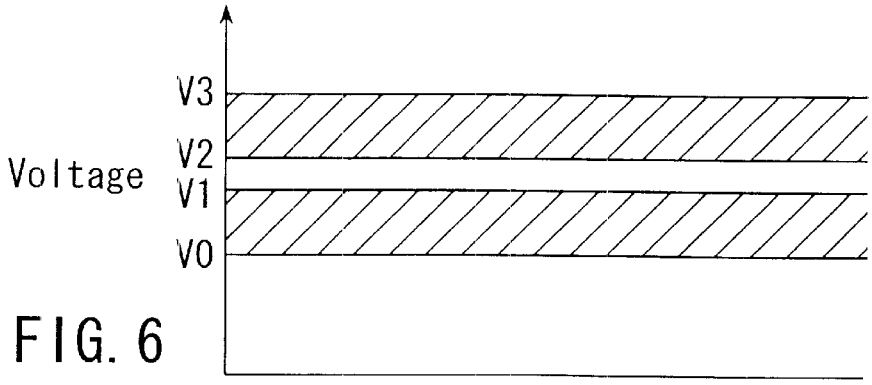
FIG. 6 shows voltage margin ranges.

FIG. 6 shows voltage margin ranges. A voltage margin range on the main body side is between a voltage V0 and a voltage V3. A voltage margin range on the induction heater side is between a voltage V1 and a voltage V2. In a hatched region in the figure, the induction heater side circuit alone generates an error status of voltage abnormality. For example, the range between voltages V0 and V3 is set at ±15%, and the range of voltages V1 and V2 is set at ±10%.

When the voltage has fallen below the voltage V1 of the voltage margin range or when the voltage has exceeded the voltage V2, the drive control section 66 of the induction heater side circuit board 60 raises the voltage abnormality error signal from Low (L) to High (H), and tells voltage abnormality to the control section 91 of the main body side circuit board 90 via the interface 67.

Figure 7:
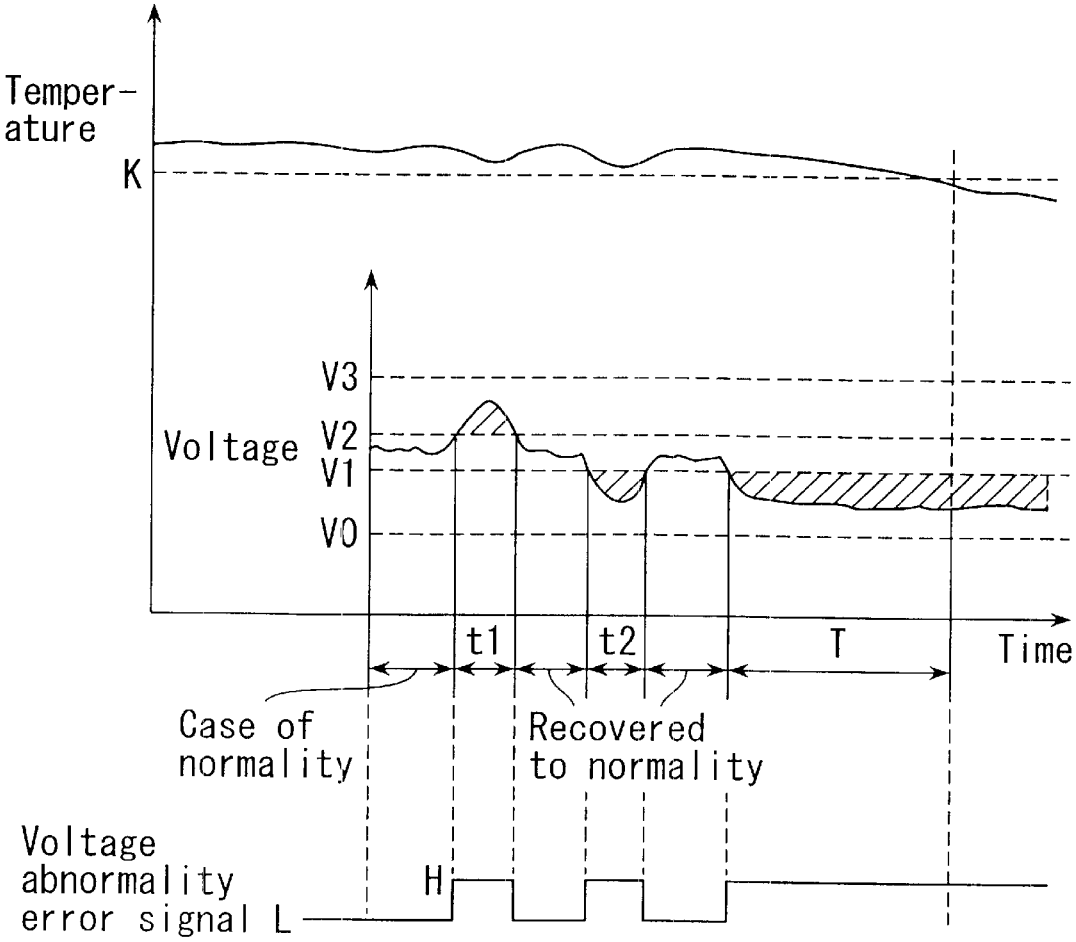
FIG. 7 is a graph showing a voltage abnormality error signal output from a drive control section in accordance with a voltage variation, in relation to a surface temperature variation of a heating roller detected by thermistors.

FIG. 7 is a graph showing a voltage abnormality error signal output from the drive control section 66 in accordance with a voltage variation, in relation to a surface temperature variation of the heating roller 41 detected by the thermistors 45 and 46.

When the voltage has exceeded the voltage V2 of the voltage margin range on the induction heater side, the voltage abnormality error signal from the drive control section 66 rises from Low (L) to High (H). Similarly, when the voltage has fallen below the voltage V1 of the voltage margin range on the induction heater side, the voltage abnormality error signal from the drive control section 66 rises from Low (L) to High (H).

The control section 91 of the main body side circuit board 90 monitors the surface temperature of the heating roller 41 using the thermistors 45 and 46. The monitoring is performed by setting a lower limit K of fixation temperatures, e.g. 160° C.

In addition, the control section 91 of the main body side circuit board 90 monitors the voltage abnormality error signal from the drive control section 66 using a timer 92, as will be described later in detail.

Figure 8:
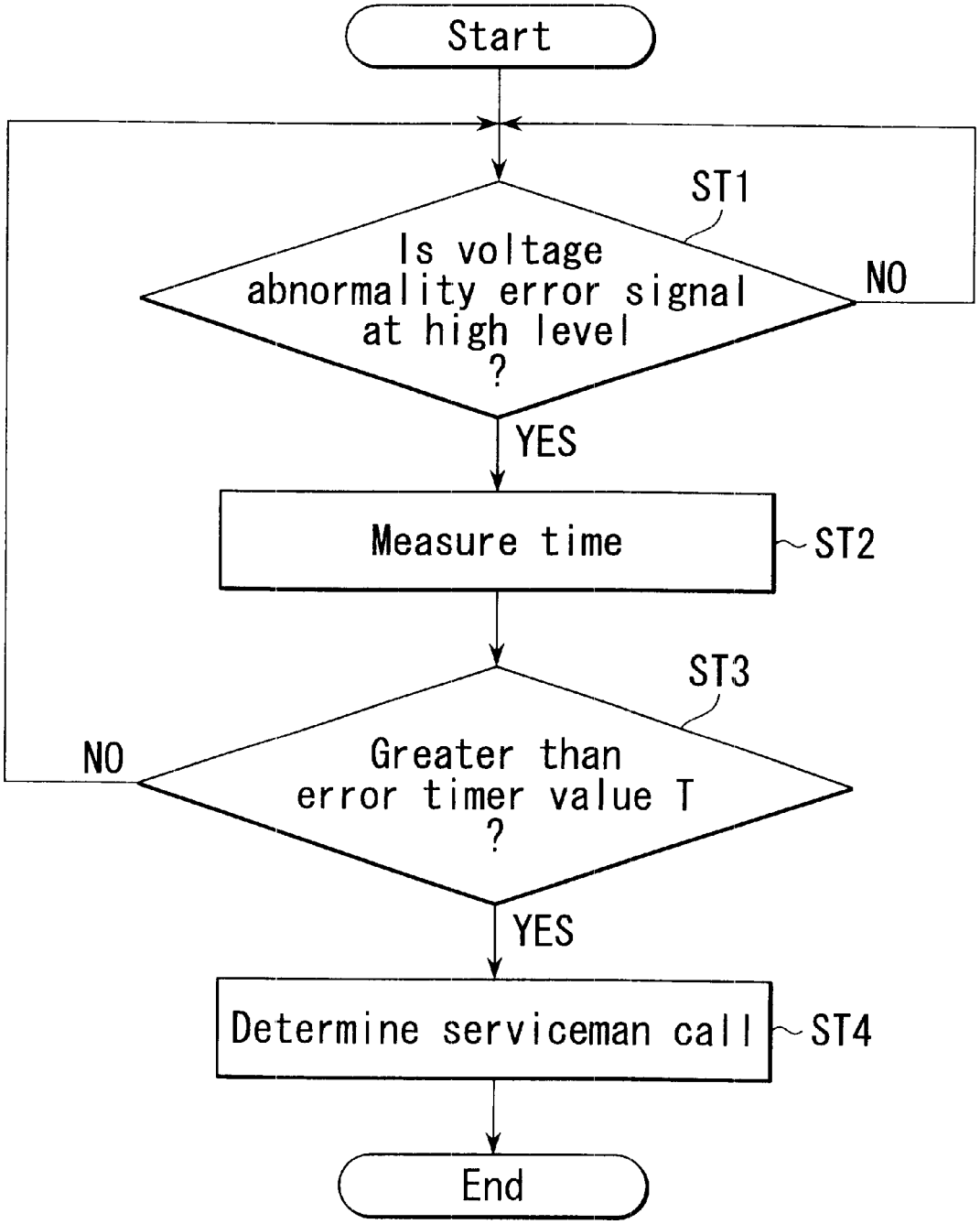
FIG. 8 is a flow chart illustrating a control operation of a control section for a voltage abnormality error signal from the drive control section.

A control operation of the control section 91 for the voltage abnormality error signal from the drive control section 66 will now be described with reference to a flow chart of FIG. 8.

When the voltage abnormality error signal from the drive control section 66 is Low (L), the control section 91 determines a normal state. When the voltage abnormality error signal has arisen to High (H) (ST1), the control section 91 does not immediately determine an abnormal state and instead measures a time (ST2).

Assume that a time period in which the voltage V2 of the voltage margin range on the induction heater side is exceeded ends at time t1, as shown in FIG. 7. Since the relationship between the time t1 of the voltage abnormality error signal from the drive control section 66 and a predetermined error timer value (limit value) T is t1<T (ST3), the control section 91 ignores this abnormal state as a temporary voltage abnormality. In short, since the abnormal state has been self-remedied at time t1 (<T), the abnormality is not determined.

The error timer value T is a several-second unit, which may affect the fixation temperature. For example, when the copying performance is 60 ppm (cpm), T=1 second. When the copying performance is 30 ppm (cpm), T=2 seconds.

Then, assume that a time period in which the voltage continues below voltage V1 of the voltage margin range on the induction heater side ends at time t2, as shown in FIG. 7. Since the relationship between the time t2 of the voltage abnormality error signal from the drive control section 66 and the error timer value T is t2<T (ST3), the control section 91 ignores this abnormal state as a temporary voltage abnormality. In short, since the abnormal state has been self-remedied at time t2 (<T), the abnormality is not determined.

Assume that a time period in which the voltage continues below voltage V1 of the voltage margin range on the induction heater side has passed over the error timer value T, as shown in FIG. 7. Since the duration of the voltage abnormality error signal from the drive control section 66 is longer than the error timer value T (ST3), the control section 91 determines a serviceman call error (SC) as the occurrence of voltage abnormality (ST4).

When other error statuses, such as IGBT abnormality, circuit failure (induction heater circuit) and coil breakage, have been issued from the drive control circuit 66, the control section 91 immediately determines the serviceman call error (SC).

According to this structure, it is possible to avoid a control-disabled state by properly coping with an error status in accordance with a voltage variation.

The present invention is also applicable to other devices wherein a coil is supplied with a radio-frequency current from a radio-frequency generating circuit to generate a radio-frequency magnetic field, thereby induction-heating a heating member.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus for forming an image, including a fixing device having a coil in a heating roller and causing the coil to generate a radio-frequency magnetic field, thereby producing an eddy current in the heating roller and fixing a developer image on a recording medium by means of self-heating of the heating roller based on an eddy current loss, the apparatus comprising:

receiving means for receiving a voltage abnormality error signal from the fixing device;

time-measuring means for measuring a reception time of the voltage abnormality error signal when the receiving means has received the voltage abnormality error signal;

confirmation means for confirming whether the reception time measured by the time-measuring means exceeds a predetermined limit value;

first control means for executing a control to ignore the voltage abnormality when the conformation means has confirmed that the limit value is not exceeded; and second control means for executing a control to perform an error process for the occurrence of voltage abnormality, when the confirmation means has confirmed that the limit value is exceeded.

2. An image forming apparatus according to claim 1, wherein the voltage abnormality error signal continues to be output in a state outside a predetermined voltage range in the fixing device.

3. An image forming apparatus according to claim 1, wherein the voltage abnormality error signal rises from a low level to a high level in a state outside a predetermined voltage range in the fixing device.

4. An image forming apparatus according to claim 1, wherein the time-measuring means is a timer.

5. An image forming apparatus according to claim 1, wherein the limit value is a time set in accordance with an image forming performance of the image forming apparatus.

6. An image forming apparatus according to claim 1, wherein the error process by the control of the control means is a process for a serviceman call error.

7. An image forming apparatus for forming an image, including a fixing device having a coil in a heating roller and causing the coil to generate a radio-frequency magnetic field, thereby producing an eddy current in the heating roller and fixing a developer image on a recording medium by means of self-heating of the heating roller based on an eddy current loss, the apparatus comprising:

first control means, provided in the fixing device, for executing a control to output a voltage abnormality error signal when a voltage outside a predetermined voltage range is sensed;

receiving means for receiving the voltage abnormality error signal from the first control means;

time-measuring means for measuring a reception time of the voltage abnormality error signal when the receiving means has received the voltage abnormality error signal; and second control means for executing a control to ignore the voltage abnormality when the reception time measured by the time-measuring means does not exceed a predetermined time, and to determine the occurrence of voltage abnormality when the reception time exceeds the predetermined time.

8. An image forming apparatus according to claim 7, wherein the first control means detects the voltage outside the predetermined range in an induction heater provided in the fixing device.

9. An image forming apparatus for forming an image, including a fixing device having a coil in a heating roller and causing the coil to generate a radio-frequency magnetic field, thereby producing an eddy current in the heating roller and fixing a developer image on a recording medium by means of self-heating of the heating roller based on an eddy current loss, the apparatus comprising:

first control means, provided in the fixing device, for executing a control to output an error signal indicative of an error occurring in the device;

receiving means for receiving the error signal from the first control means;

processing means for immediately executing an error process when the error signal received by the receiving means is not a signal indicative of voltage abnormality;

time-measuring means for measuring a reception time of the error signal when the error signal received by the receiving means is the signal indicative of voltage abnormality; and second control means for executing a control to ignore the voltage abnormality when the reception time measured by the time-measuring means does not exceed a predetermined time, and to perform the error process through the processing means for the occurrence of voltage abnormality when the reception time exceeds the predetermined time.

10. An image forming apparatus according to claim 9, wherein the first control means executes the control to output the error signal by sensing errors, such as voltage abnormality, IGBT abnormality, circuit failure and coil breakage, in an induction heater provided in the fixing device.

* * * * *